US005569024A

United States Patent [19]

Dummersdorf et al.

[11] Patent Number: 5,569,024

[45] Date of Patent: Oct. 29, 1996

[54] PUMP FOR DELIVERING HOT, CORROSIVE MEDIA

[75] Inventors: Hans-Ulrich Dummersdorf, Burscheid; Helmut Waldman; Helmut Härle, both of Leverkusen; Franz-Rudolf Minz, Dormagen; Fritz Gestermann, Leverkusen, all of Germany

[73] Assignee: Bayer Aktiengesellschaft, Leverkusen, Germany

[21] Appl. No.: 523,886

[22] Filed: Sep. 6, 1995

[30] Foreign Application Priority Data

Sep. 13, 1994 [DE] Germany ..... 44 32 551.7

[51] Int. Cl.[6] ..... F04B 17/00

[52] U.S. Cl. ..... 417/420; 417/410.4; 417/53; 418/104; 418/206.6; 277/3; 277/53

[58] Field of Search ..... 417/420, 410.4, 417/53; 418/104, 206.6; 277/3, 17, 53, 55, 70

[56] References Cited

U.S. PATENT DOCUMENTS

| | | | |
|---|---|---|---|
| 4,792,244 | 12/1988 | Yamashita et al. . | |
| 4,846,641 | 7/1989 | Pieters et al. | 417/420 |
| 4,958,988 | 9/1990 | Regev . | |
| 5,263,825 | 11/1993 | Doolin . | |
| 5,263,829 | 11/1993 | Gergets | 417/420 |
| 5,288,213 | 2/1994 | Nasr | 417/420 |
| 5,334,004 | 8/1994 | Lefevre et al. | 277/3 |
| 5,427,500 | 6/1995 | Hyll | 277/3 |

FOREIGN PATENT DOCUMENTS

| | | | |
|---|---|---|---|
| 467011 | 1/1992 | European Pat. Off. | 417/420 |
| 0499504 | 8/1992 | European Pat. Off. . | |
| 0590777 | 4/1994 | European Pat. Off. . | |

*Primary Examiner*—Charles G. Freay

*Attorney, Agent, or Firm*—Sprung Horn Kramer & Woods

[57] ABSTRACT

A pump for delivering hot, corrosive material having a shaft seal comprising a seal gap through which hot gases flow, and wherein the sealing gases also flow around the pump bearings for the purpose of cooling the bearings.

8 Claims, 1 Drawing Sheet

PUMP FOR DELIVERING HOT, CORROSIVE MEDIA

BACKGROUND OF THE INVENTION

The invention relates to a pump for delivering corrosive media of a high temperature and to a method for operating this pump. Pumps for delivering hazardous media are known. Magnetically coupled pumps are in most cases used for this purpose in order to avoid problems concerning tightness at drive shaft bushes, which are usually inevitable. In this case the actual delivery medium is used to lubricate the bearing, which is usually disposed in the vicinity of the internally operating magnets, and therefore fills the entire pump interior. Various materials may be used for the entire pump interior where corrosive media are concerned. It is also known to seal off the pump chamber from the pump interior by, for example, axial ring seals and to separately lubricate the shaft bearings lying in the vicinity of the inner magnets, for example by means of a side stream of the delivery medium. The disadvantage of these pumps lies in the fact that they cannot deliver highly corrosive media. Added to this problem is the fact that the highly corrosive media which are to be delivered have a high temperature (>300° C.), as is the case of, for example, salt melts, and no sealing material satisfies these two requirements regarding resistance to heat and corrosion. Moreover, the inner pump magnets increasingly lose their magnetism at higher temperatures, this gradually disappearing at temperatures above 400° C. in the case of currently known magnetic materials, so that the pump becomes unserviceable.

There is known in the prior art a pump unit for delivering hot media which has a cooling flow guide such that the cooling air flow of the electric motor driving the pump is directed towards the bearing supports and the magnetic coupling. The operating temperature of the magnets and the bearings is as a result lowered in a way which simplifies construction, even when delivering hot media, and the pump remains in working order. However a pump of this kind is not suitable for delivering hot, highly corrosive media, such as salt melts, as a large number of parts which are contacted by the media and which would very quickly be corroded by the salt melt are disposed in the interior.

DE-A 4 212 982 proposes a magnetically coupled pump for delivering hot media. The object of this invention is also to cool bearings and magnets when delivering hot media so as to confine the bearing and magnet temperatures. This object is solved in that a coolant inflow channel is provided in the drive shaft for the outer magnet support, which channel communicates with a coolant gap which in turn communicates with the outer magnet support and the inside of an outer pump enclosure, the cooling fluid being evacuated from the outer enclosure again. Media of temperatures between 200° and 300° C. can be delivered by a pump according to this solution, in which case the bearing temperatures should not exceed 50° to 60° C. However the proposed pump cannot fulfil the requirement of guaranteeing a reliable seal against a highly corrosive medium which is to be delivered directly in its bearings lying closest to the pump casing, this being impossible to achieve with known sealing materials which are necessary in the construction which is presented. Moreover, the cooling of the inner bearings which is provided would cause crystallisation of the salt melt in the bearing, resulting directly in its destruction not just through corrosion, but also through erosion. The proposed solution cannot prevent salt melt from passing out of the pump casing through the inner bearings and into the pump interior, as no suitable sealing materials are available. However a process of this kind very quickly destroys the pump.

The object is therefore to find a pump and a method for operating this pump which permit the delivery of highly corrosive and high-temperature media such as, e.g. chloride or Cu salt melts of temperatures exceeding 400° C., with the pump being of a simple structure, reliable and inexpensive to operate.

SUMMARY OF THE INVENTION

Given a pump with a drive part and a pump body, in which the drive shaft is sealed off from the medium to be delivered by a shaft seal, this object is solved according to the invention in that the shaft seal consists of a stator ring which is fitted into the pump body and/or into the drive part and through which the drive shaft is passed while leaving a seal gap, that the pump body and the stator ring, including all the parts in the body which contact the media, are manufactured from a material which is resistant to corrosion and high temperatures, that one or more dry-running bearings is/are arranged in the drive part to mount the drive shaft, and that the drive part comprises a gas flow channel which has a supply connection and a discharge connection and which communicates in terms of flow with the seal gap.

A preferred embodiment lies in the fact that the rotational movement in the drive part is transmitted to the drive shaft by a magnetic coupling.

The dry-running bearing in the drive part advantageously consists of a ceramic rolling contact bearing. The running surfaces of the dry-running bearing may be coated with an inorganic film, e.g. with carbon, in order to reduce the sliding friction.

It may also be appropriate to arrange another conventional shaft seal, e.g. an axial ring seal, between the stator ring and the drive part.

The object which is set is also solved by a method for operating the pump wherein according to the invention a hot gas is admitted to the gas flow channel via the supply connection and leaves the drive part again through the discharge connection, the supply pressure being set such that the static pressure of the gas in the gas flow channel above the stator ring is higher than the pressure of the delivery medium which partially or completely fills the pump body.

According to a preferred embodiment the temperature of the hot gas is set to a value above 120° C. and the static pressure of the hot gas in the flow channel to a value above 1.5 bar.

Superheated steam is advantageously used as the hot gas.

The hot gas pressure is in addition appropriately regulated by a control circuit to a desired value which is higher than the delivery pressure of the medium delivered by the pump.

It may in an individual case be appropriate to use instead of superheated steam another hot gaseous medium such as air, nitrogen, oxygen or carbon dioxide for admission to the gas flow channel in the drive part.

BRIEF DESCRIPTION OF THE DRAWINGS

The invention is described in detail in the following on the basis of an embodiment which is represented in the drawing. The figure shows the basic structure of a pump which is resistant to high temperatures and corrosion and is based on a magnetically coupled gear pump. The pump is divided into the pump body 1 and the drive section 2, the pump body 1 and the drive section 2 being separated by a ceramic stator ring 3 which is fitted into the pump body 1 and through which the drive shaft 4 (pump shaft) is passed. The opening in the stator ring 3 for the passage of the pump shaft 4 has a slightly larger diameter than the pump shaft, so that a seal gap 5 remains between the pump shaft 4 and the inner surface at the opening of the stator ring.

The pump body 1, including all the parts which contact the media, consists of a material which is resistant to high temperatures and corrosion, such as a ceramic, stoneware, etc. The actual pump consists of a gear pump 6, which is arranged in the pump body 1 and also manufactured from a ceramic material, including the pump shaft. The hot corrosive medium which is to be delivered flows perpendicularly through the intake connection 7 of the gear pump 6 in the direction of the gear-wheels, is compressed between the teeth and leaves the pump through a corresponding pressure connection on the opposite side of the gear pump 6. The pump shaft or drive shaft 4 is firmly connected in the drive section 2 to a cylindrical squirrel-cage rotor 9, which can freely rotate in a casing opening 10 of an appropriate size in the drive section 2. The squirrel-cage rotor 9 is mounted by means of ceramic rolling contact bearings 11, which are arranged between the squirrel-cage rotor 9 and a cylindrical bearing shell 12, which is firmly connected to the pump section 1 and extends in the axial direction.

Figure 1:
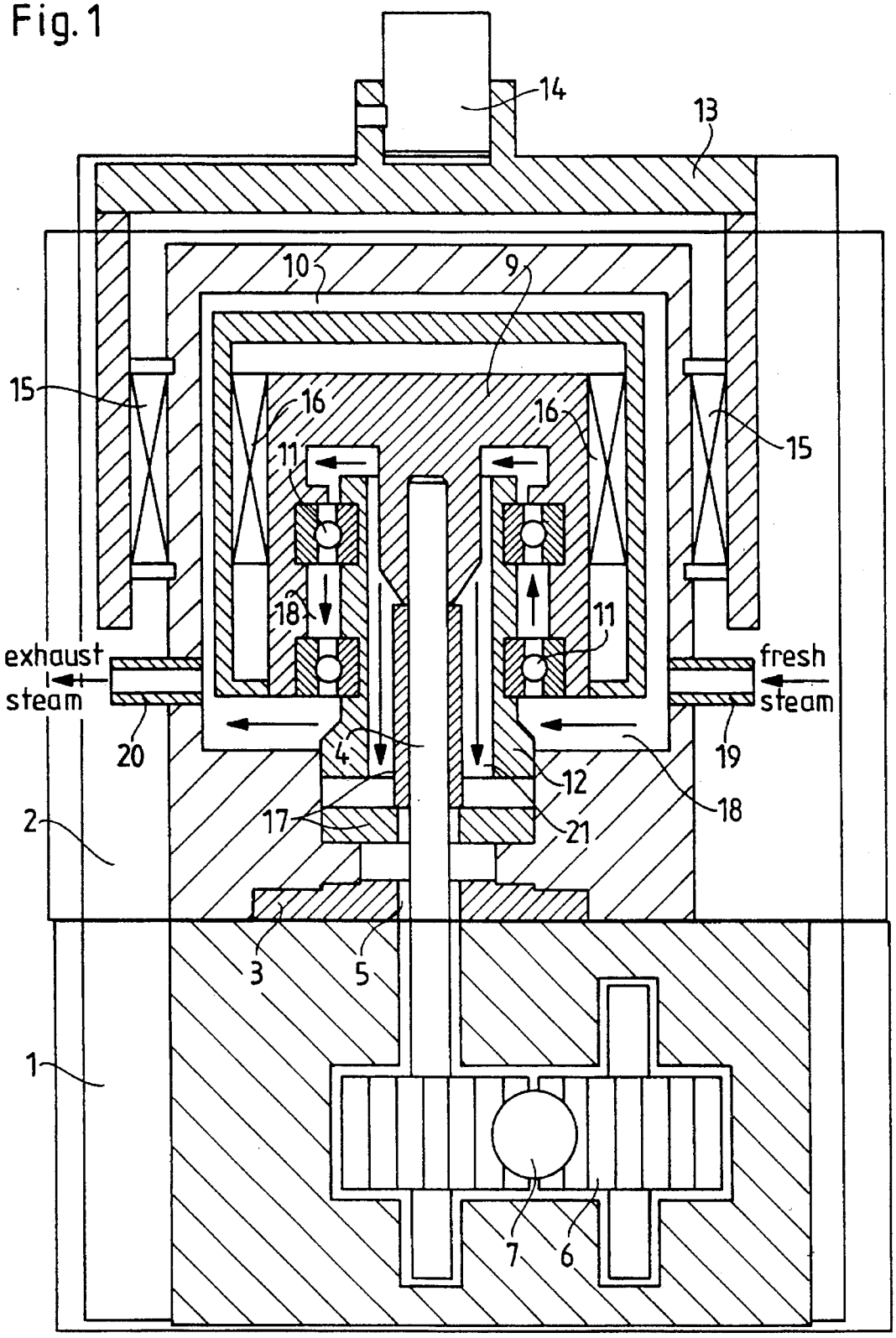

A pot-shaped rotor 13, which is connected via a drive shaft 14 to an electric motor, is arranged concentrically about the squirrel-cage rotor 9. A magnetic pole collar 15 is arranged on the inside of the rotor 13 and, together with an opposite magnetic pole collar 16 on the squirrel-cage rotor 9, forms a magnetic coupling which serves to transmit the rotational movement from the motor shaft 14 to the drive/pump shaft 4. The motor shaft 14 could, however, also be directly connected to the drive shaft 4. Another conventional seal, e.g. an axial ring seal 17, may be provided in addition to the stator ring 3 to improve the seal between the pump section 1 and the drive section 2.

An important construction feature lies in the fact that the drive section 2, in particular the squirrel-cage rotor 9, is provided with a gas flow channel 18. Hot gas or superheated steam is admitted to the gas flow channel 18 via a supply connection 19. The hot gas firstly flows through a radial, annular section, then through an axial gap parallel to the bearing shell 12, flowing around the ceramic rolling contact bearings 11, and finally leaves the drive section 2 through a discharge connection 20. The gas flow channel 18 also communicates via an annular connecting channel 21 parallel to the drive shaft 4 with the seal gap 5 between the stator ring 3 and the drive shaft 4. The level of the supply pressure for the hot gas at the supply connection 19 is selected such that the static pressure of the superheated steam in the connecting gap 21 is higher than the pressure of the delivery medium in the gear pump 6. It is thus possible to prevent the hot aggressive delivery medium, e.g. a salt melt, from passing through the seal gap 5 and the axial ring seal 17 into the drive section 2.

Whereas the pump body 1 including the gear pump 6 and the drive shaft 4 are manufactured from a ceramic material, the drive section—apart from the ceramic rolling contact bearings 11—may consist of metal, this being a vital advantage of the invention. The running surfaces of the rolling contact bearing 11 are advantageously coated with a carbon film in order to reduce the sliding friction.

In accordance with the method according to the invention the pump according to the invention is based on the following working principle:

The delivery medium, e.g. a salt melt at a temperature of 500° C., is taken in via the intake connection 7 of the gear pump 6, compressed between the ceramic gear-wheels and leaves the pump body 1 at a pressure of 5 bar. The pump shaft 4 is passed through the stator ring 3 with a slight clearance (seal gap 5). The stator ring 3 separates the pump body 1 and the drive section 2 of the pump from one another, except for the slight gap with respect to the pump shaft 4 and the pump body 1. The drive section 2 is now supplied via the gas supply connection 19 in a pressure-regulated manner with steam which is at a pressure of 5.1 bar and a temperature of 180° C. and leaves the drive section 2 again via the gas discharge connection 20. The fluid salt melt is prevented from passing through the seal gap 5 between the stator ring 3 and the pump shaft 4 and between the stator ring 3 and the pump body 1 owing to the steam in the drive section 2 being at a pressure in excess of atmospheric pressure. A small amount of steam flows from the drive section 2 into the salt melt disposed in the pump body 1. The small amount of steam flowing into the salt melt can be tolerated if the salt melt is not influenced chemically and the delivery capacity of the gear pump is not negatively influenced by steam bubbles contained in the salt melt. This flow of steam can be further minimised by the conventional axial ring seal 17 between the stator ring 3 and the front part of the rolling contact bearing 11. The superheated steam which flows through the drive section 2 also has an important second function: It ensures that the pump magnets 16 and the dry-running bearings 11 are directly cooled to temperatures below 350° C., this being an important factor. Because of the barrier action of the steam in the drive section 2, salt melt of a temperature of 500° C. is effectively prevented from penetrating into the drive part 2 and, in order to remove heat flowing from the pump body 1 into the drive section 2, the pump magnets 16 are cooled so that their action is not impaired. The bearings 11 are likewise intensively cooled with superheated steam. None of the components in the drive section 2 come into contact with the delivery medium and can all be made of, for example, conventional special steel, with the exception of the ceramic, dry-running bearing 11. The steam which is used in the drive section 2 of the pump and which is heated in the pump can subsequently be re-used. The pump should preferably be operated in an upright position, so that the pump body 1 is arranged at the bottom and the drive section 2 above it. The entire pump body 1 is electrically heated from outside in order to maintain the pump at the operating temperature and prevent thermal stresses in the ceramic components.

We claim:

1. Pump for delivering hot corrosive media, comprising a drive section, a pump body, and a drive shaft which is sealed off from the medium to be delivered by a shaft seal, wherein a) the shaft seal consists of a stator ring separating the pump body and the drive section and through which the drive shaft passes while leaving a seal gap between said drive shaft and said stator ring, and wherein b) the pump body, the stator ring and all portions of the pump body which contact the media to be pumped, are manufactured from a material which is resistant to corrosion and high temperatures, and wherein c) one or more dry-running bearings are arranged in the drive section to mount the drive shaft and further comprising d) a gas flow channel in the drive section, having a gas supply inlet and a gas discharge, and which communicates with the dry-running bearings and seal gap so as to enable gas supplied to the inlet to flow around the dry running bearings, and a portion of said gas to then enter the seal gap in the drive section and flow through said seal gap into the pump body, while the remainder of the gas leaves the drive section through the gas discharge.

2. Pump according to claim 1, wherein a magnetic coupling is provided in the drive section to transmit rotational movement to the drive shaft.

3. Pump according to 1, wherein the dry-running bearing is a ceramic rolling contact bearing.

4. Pump according to claim 1, wherein the dry-running bearing has coatings on the running surfaces to reduce the coefficient of sliding friction.

5. Pump according to claim 1, further comprising a conventional axial ring seal between the stator ring and the drive section.

6. A method for pumping a corrosive material which comprises pumping said material with a pump according to claim 1, wherein a hot gas is supplied to the gas supply inlet of said pump at a pressure sufficient to maintain the pressure in the gas flow channel of said pump at a pressure which is higher than the pressure of the corrosive material in the pump body of said pump.

7. Method according to claim 6, wherein the temperature of the hot gas is above 120° C. and the pressure of the hot gas in the gas flow channel is above 1.5 bar.

8. Method according to claim 6, wherein said hot gas is superheated steam.

* * * * *

UNITED STATES PATENT AND TRADEMARK OFFICE

CERTIFICATE OF CORRECTION

PATENT NO. : 5,569,024
DATED : October 29, 1996
INVENTOR(S) : Dummersdorf, et al.

It is certified that error appears in the above-indentified patent and that said Letters Patent is hereby corrected as shown below:

Col. 5, line 8 After " to " insert -- claim --

Signed and Sealed this

Eighteenth Day of March, 1997

*Attest:*

Bruce Lehman

BRUCE LEHMAN

*Attesting Officer*

*Commissioner of Patents and Trademarks*